US010410612B1

(12) United States Patent
Santana

(10) Patent No.: US 10,410,612 B1
(45) Date of Patent: Sep. 10, 2019

(54) HANDHELD GUIRA ASSEMBLY

(71) Applicant: Quitara, LLC, Seminole, FL (US)

(72) Inventor: Radames Santana, Seminole, FL (US)

(73) Assignee: Quitara, LLC, Seminole, FL (US)

( * ) Notice: Subject to any disclaimer, the term of this patent is extended or adjusted under 35 U.S.C. 154(b) by 0 days.

(21) Appl. No.: 16/205,442

(22) Filed: Nov. 30, 2018

(51) Int. Cl.
*G10D 13/06* (2006.01)

(52) U.S. Cl.
CPC ..... *G10D 13/06* (2013.01)

(58) Field of Classification Search
CPC ..... G10D 13/06
See application file for complete search history.

(56) References Cited

U.S. PATENT DOCUMENTS 1,495,672 A * 5/1924 Cheney ..... G10D 13/06 84/402
3,375,747 A * 4/1968 Posey ..... G10D 3/00 84/267
3,779,126 A * 12/1973 Hoey ..... G10D 13/06 84/418
D244,635 S 6/1977 Cohen
6,069,308 A * 5/2000 Rabb ..... G10D 13/003 446/397
6,169,237 B1 * 1/2001 Sanders ..... G10D 13/06 84/102
6,369,304 B1 4/2002 Tucker
6,512,169 B1 * 1/2003 Santini ..... G10D 13/06 446/418
7,317,157 B2 * 1/2008 Cslovjecsek ..... G10D 13/06 84/410
7,842,866 B1 * 11/2010 Atkinson ..... G10D 13/06 84/290
7,923,616 B2 * 4/2011 Hamilton ..... G10D 3/163 84/267
8,614,383 B1 * 12/2013 Palais ..... G10D 1/08 84/294
8,853,511 B2 * 10/2014 DePue, Jr. ..... G10D 3/00 84/274
8,907,201 B2 * 12/2014 Jensen ..... G10D 15/00 84/743
9,240,168 B1 * 1/2016 Steinberger ..... G10D 1/08
D755,886 S * 5/2016 Luz ..... D17/22
(Continued)

*Primary Examiner* — Robert W Horn
(74) *Attorney, Agent, or Firm* — Mark C. Johnson; Johnson |Dalal

(57) ABSTRACT

A handheld guira assembly that comprises a guitar-shaped body coupled to a neck, operably configured to be handheld. The handheld guira assembly further comprises a substantially rigid guira plate, of a metallic material, superimposing and coupled to the upper surface of the guitar-shaped body. The guira plate includes a textured surface disposed on substantially the entire upper surface area. The handheld guira assembly further comprises a handheld scraper with a handle portion and a plurality of substantially rigid bristles, of a metallic material, coupled to, yet extending away from, the handle portion, and disposed in a parallel configuration with respect to one another. When a user strikes the handheld scraper along the textured upper surface of the guira plate, the handheld guira assembly generates musical guira percussion sounds. Therefore, the handheld guira assembly provides an alternate method of holding a guira musical device in addition to more playing surface area.

18 Claims, 5 Drawing Sheets

(56) References Cited

U.S. PATENT DOCUMENTS

| | | | | |
|---|---|---|---|---|
| 10,037,747 | B1 * | 7/2018 | Lenz | G10D 13/06 |
| 2004/0123722 | A1 | 7/2004 | Cohen | |
| 2004/0206224 | A1 * | 10/2004 | Cohen | G10D 13/06<br>84/410 |

* cited by examiner

HANDHELD GUIRA ASSEMBLY

FIELD OF THE INVENTION

The present invention relates generally to handheld musical percussion instruments, and, more particularly, relates to a handheld guira assembly.

BACKGROUND OF THE INVENTION

Typically, musical percussion instruments are instruments which make sounds when they are struck, shaken, or scraped. Often, percussion instruments are used as part of orchestras and bands to make rhythm and sound. The guira in particular is a type of handheld musical percussion instrument which consists of a metal sheet and a scraper which a user may combine to make a beat. Often, the metal sheet of a guira is embodied as a metal cylinder which has a textured surface, which may be described as knurling, ridges, striations, or grooves. The metal cylinder usually incorporates a handle so that a user may hold the instrument with one hand while they play it. The user holds a comb-like scraper in the other hand which is used to strike and grate the metal cylinder's textured surface to make a beat. However, this embodiment of a guira has several drawbacks. As a result of having a handle which a user needs to hold by hand as they play the instrument, the metal cylinder is limited in size and weight, therefore, it has limited amount of textured surface, or playing area. For these reasons, development of guiras and percussion attachments which employ different methods for a user to grasp the instrument while playing have emerged. These efforts, however, have resulted in the creation of guiras and percussion attachments that are often inefficient at providing both an alternative method of grasping the instrument while also expanding the playing area.

Several known percussion attachments which have a guira-like surface are aimed at attaching to stringed musical instruments. These devices are typically used alongside the stringed musical instrument. However, the primary objective of these devices is usually to guard and protect the stringed musical instrument body, only with a secondary objective to produce a beat when struck. Therefore, these devices do not incorporate an alternative method of holding the handheld musical percussion instrument while also simultaneously expanding the surface area of a guira.

Other known percussion attachments which have a guira-like surface can attach to bowed stringed musical instruments and are intended to be struck with the bow. These devices are aimed at producing percussion sounds but also have an objective of protecting the stringed musical instrument body or maintaining the structural integrity of the stringed musical instrument. However, first, these devices are played with a bow and not a scraper, thereby producing an entirely different musical sound effect. Moreover, these devices do not address the need of producing a device which incorporates both an alternative method of grasping the device while also expanding the surface area of a guira. In fact, the surface area of these percussion attachments is usually much smaller than that of a guira.

Many other known guira devices incorporate a guira and a shaker, or maracas, within a singular device. However, these devices are designed to accomplish the objective of combining both percussion instruments into one and not expanding the playing surface area while also providing an alternate means of holding the device.

Therefore, a need exists to overcome the problems with the prior art as discussed above.

SUMMARY OF THE INVENTION

The invention provides a handheld guira assembly that overcomes the hereinafore-mentioned disadvantages of the heretofore-known devices and methods of this general type and that efficiently incorporates an alternative method of grasping the instrument and an expanded surface or playing area.

With the foregoing and other objects in view, there is provided, in accordance with the invention, a handheld guira assembly comprising a guitar-shaped body having a rear surface, an upper surface opposing the rear surface, a left side, a right side opposing the left side, a front end, and a back end opposing the front end. The handheld guira assembly also includes a neck with a proximal end coupled to the front end of the guitar-shaped body and extending outwardly therefrom to a distal terminal free end, wherein the guitar-shaped body and neck are operably configured to be handheld. The handheld guira assembly also includes a spring-loaded and substantially rigid guira plate.

In some embodiments, the spring-loaded and substantially rigid guira plate is coupled to and superimposes the upper surface of the guitar-shaped body. Moreover, the spring-loaded and substantially rigid guira plate has a rear surface and an upper surface opposing the rear surface with an upper surface area defined by an outer perimeter of the upper surface of the guira plate. Additionally, the spring-loaded and substantially rigid guira plate has a plurality of tightly spaced raised sound nodules disposed on over 50% of the upper surface area of the guira plate.

In accordance with another feature, the guira plate and sound nodules are of a metallic material.

In accordance with another feature, the handheld guira assembly further comprises a handheld scraper with a handle portion and a plurality of substantially rigid bristles extending away from and coupled to the handle portion, the plurality of bristles disposed in a parallel configuration with one another.

In accordance with a further feature, the sound nodules are rounded at a distal tip thereof and enclosed.

In accordance with another feature, the sound nodules are tightly placed apart from one another no greater than 0.25 inches.

In accordance with another feature, the plurality of sound nodules are disposed on over 75% of the upper surface area of the guira plate.

In accordance with yet another feature, the plurality of sound nodules are disposed on substantially the entire upper surface area of the guira plate.

In accordance with a further feature, the handheld guira assembly further comprises a strap having a first end and a second end each coupled to the guitar-shaped body to define a strap enclosure with respect to the guitar-shaped body.

In accordance with another feature, the handheld guira assembly further comprises a first plurality of spring members disposed proximal to the left side of the guitar-shaped body, interposed between the upper surface of the guitar-shaped body and the rear surface of the guira plate, and each retained, respectively, with a plate fastener. Moreover, the handheld guira assembly comprises a second plurality of spring members disposed proximal to the right side of the guitar-shaped body, interposed between the upper surface of the guitar-shaped body and the rear surface of the guira plate, and each retained, respectively, with a plate fastener.

In some embodiments, the handheld guira assembly comprises a body having a rear surface, an upper surface opposing the rear surface, a left side, a right side opposing the left side, a front end, and a back end opposing the front end. Moreover, the handheld guira assembly comprises a neck with a proximal end coupled to the front end of the body and extending outwardly therefrom to a distal terminal free end, wherein the body and neck are operably configured to be handheld. Additionally, the handheld guira assembly comprises a substantially rigid guira plate coupled to the body, having a rear surface and an upper surface opposing the rear surface of the guira plate and with an upper surface area defined by an outer perimeter of the upper surface of the guira plate, the guira plate superimposing the upper surface of the body. Moreover, the substantially rigid guira plate has a plurality of tightly spaced raised sound nodules disposed on over 75% of the upper surface area of the guira plate.

In accordance with another feature, the guira plate is coupled to the upper surface of the body with a plurality of spring members, thereby allowing the guira plate to deform with respect to the upper surface of the body.

In accordance with another feature, the plurality of spring members each further comprise of a first plurality of spring members disposed proximal to the left side of the guitar-shaped body, interposed between the upper surface of the guitar-shaped body and the rear surface of the guira plate, and each retained, respectively, with a plate fastener. Moreover, the plurality of spring members each further comprise of a second plurality of spring members disposed proximal to the right side of the guitar-shaped body, interposed between the upper surface of the guitar-shaped body and the rear surface of the guira plate, and each retained, respectively, with a plate fastener.

In accordance with another feature, the handheld guira assembly further comprises a strap having a first end and a second end each coupled to the guitar-shaped body to define a strap enclosure with respect to the guitar-shaped body.

In some embodiments, the handheld guira assembly comprises a guitar-like base having a guitar-shaped body and a neck. The guitar-shaped body includes a rear surface, an upper surface opposing the rear surface, a left side, a right side opposing the left side, a front end, and a back end opposing the front end. The guitar-shaped body further includes a substantially rigid guira plate. The substantially rigid guira plate is of a metallic material, has a plurality of plate fastener openings, is coupled to the upper surface of the guitar-shaped body utilizing a plurality of plate fasteners, has a rear surface, an upper surface opposing the rear surface, and an upper surface area defined by an outer perimeter of the upper surface. The substantially rigid guira plate superimposes the upper surface of the guitar-shaped body and has a textured surface disposed on substantially the entire upper surface area of the guira plate. The guitar-like base further includes the neck having a proximal end coupled to the front end of the guitar-shaped body and extending outwardly therefrom to a distal terminal free end, wherein the guitar-shaped body and neck are operably configured to be handheld. Moreover, the handheld guira assembly further comprises a handheld scraper having a handle portion and a plurality of substantially rigid bristles. The plurality of substantially rigid bristles are of a metallic material, extend away from and couple to the handle portion, and are disposed in a parallel configuration with respect to one another.

In accordance with another feature, the guitar-shaped body further comprises of a first plurality of spring members disposed proximal to the left side of the guitar-shaped body, interposed between the upper surface of the guitar-shaped body and the rear surface of the guira plate, and each retained, respectively, with at least one of the plurality of plate fasteners. Moreover, the guitar-shaped body further comprises of a second plurality of spring members disposed proximal to the right side of the guitar-shaped body, interposed between the upper surface of the guitar-shaped body and the rear surface of the guira plate, and each retained, respectively, with at least one of the plurality of plate fasteners.

In accordance with another feature, the handheld guira assembly further comprises a strap having a first end and a second end each coupled to the guitar-shaped body to define a strap enclosure with respect to the guitar-shaped body.

In accordance with another feature, the handheld guira assembly further comprises a trigger system operably configured to create a signal by detecting vibrations emerging from the guira plate and transmitting the signal to an electronic component which generates a sound.

In accordance with another feature, the trigger system further comprises a drum trigger microphone operably configured to detect vibrations and generate an electrical signal and configured to be removably mounted onto the upper surface of the guitar-shaped body, interposed between the upper surface of the guitar-shaped body and the rear surface of the guira plate. The drum trigger microphone operates as a type of transducer converting vibrations, or sound waves, into an electrical signal. The drum trigger microphone further includes an electrical output coupled to an electrical lead operably configured to communicate the electrical signal. The trigger system further comprises an electronic component operably configured to communicate with the drum trigger microphone and adapted to produce sounds representing musical percussion guira sounds based on the received electrical signal. The electronic component has an input of complementary coupling configuration with the electrical output.

One objective of the present invention is to provide a handheld guira assembly which incorporates more surface area for striking the instrument.

Another objective is to provide a handheld guira assembly with a shoulder strap to provide a user with a more comfortable and easier method of simultaneously holding and playing the instrument.

Although the invention is illustrated and described herein as embodied in a handheld guira assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the assembly. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

FIG. 1A is a fragmentary close-up view of a plurality of tightly spaced raised sound nodules of the guira plate in FIG. 1 in accordance with one embodiment of the present invention;

DETAILED DESCRIPTION

Figure 1:
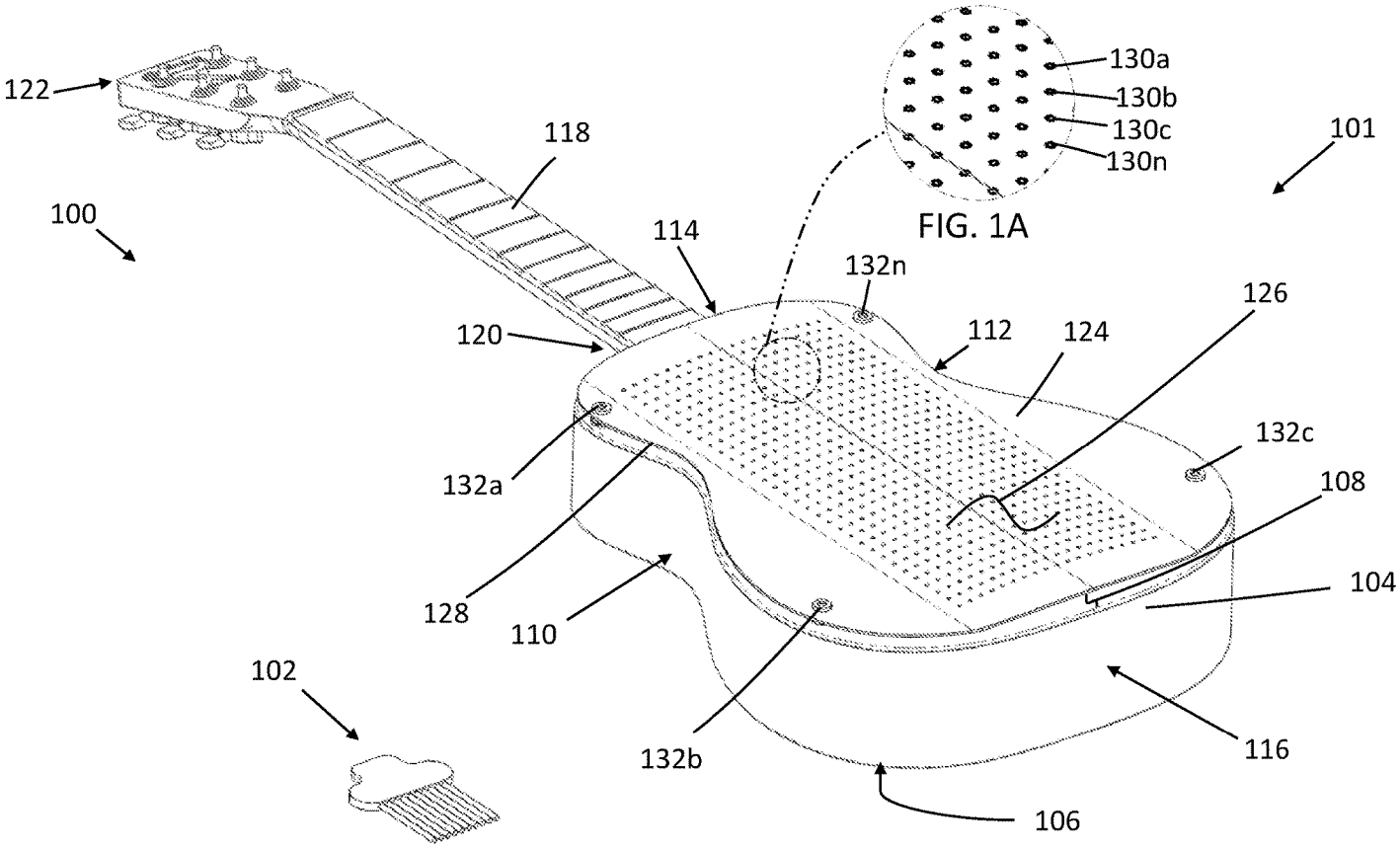
FIG. 1 is a perspective view of a handheld guira assembly according to one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms. Therefore, specific structural and functional details disclosed herein are not to be interpreted as limiting, but merely as a basis for future claims and as a representative basis for teaching one of ordinary skill in the art to variously employ the present invention in virtually any appropriately detailed structure. Further, the terms and phrases used herein are not intended to be limiting; but rather, to provide an understandable description of the invention. It is believed that the invention will be better understood from a consideration of the following description in conjunction with the drawing figures, in which like reference numerals are carried forward. The figures of the drawings are not drawn to scale.

The present invention provides a novel and efficient handheld guira assembly which offers an alternative method of holding the device and a larger guira surface playing area. More specifically, embodiments of the invention provide a guira assembly composed of a guitar-like body coupled to a spring-loaded and substantially rigid guira plate having a plurality of raised sound nodules disposed in a close proximity with respect to one another. In addition, embodiments of the present invention also provide a handheld scraper that allow a user to strike the guira device and generate percussion sounds.

Referring now to FIGS. 1-4, one embodiment of the present invention is shown in a perspective view. FIG. 1, along with other figures, show several advantageous features of the present invention, but, as will be described below, the invention can be provided in several shapes, sizes, combinations of features and components, and varying numbers and functions of the components. The first example of a handheld guira assembly 100, as shown in FIG. 1, includes a guitar-like base 101. The guitar-like base 101 includes a guitar-shaped body 104 beneficially coupled to a neck 118. The guitar-shaped body 104 includes a rear surface 106, an upper surface 108 opposing the rear surface 106, a left side 110, a right side 112 opposing the left side 110, a front end 114, and a back end 116 opposing the front end 114. The neck 118 includes a proximal end 120 coupled to the front end 114 of the guitar-shaped body 104. The neck 118 extends outwardly from the front end 114 of the guitar-shaped body 104 to a distal terminal free end 122. Together, the guitar-shaped body 104 and the neck 118 are operably configured to be handheld. The guitar-like base 101 also includes a substantially rigid guira or striking plate 124 coupled to the guitar-shaped body 104. To effectuate placement of the guira plate 124, the base 101 may utilize a plurality of plate fasteners 132*a-n*, where "n" represents any number greater than one. The guira plate 124 is coupled to the guitar-shaped body 104 on the upper surface 108, wherein the guira plate 124 superimposes the upper surface 108. The guira plate 124 includes an upper surface 126 and a rear surface 406 (shown in FIG. 4) opposing the upper surface 126. The upper surface 126 includes an upper surface area defined by an outer perimeter 128. The upper surface 126 includes a plurality of tightly spaced raised sound nodules 130*a-n*, where "n" represents any number greater than one (shown in FIG. 1A). The assembly 100 also includes a handheld scraper 102 which comprises a handle portion 202 coupled to a plurality of substantially rigid bristles 204*a-n*, where "n" represents any number greater than one (shown in FIG. 2).

It should also be understood that terms such as, "front," "rear," "side," top," "bottom," and the like are indicated from the reference point of a viewer viewing the guitar-like base 101 from the perspective of its upper surface 108 when the neck 118 is facing upwards (see FIG. 1).

In one embodiment, the guitar-like base 101 may be of wood (e.g., mahogany, ash, maple, walnut), plastic (e.g., PVC, carbon fiber), metallic material (e.g., aluminum, steel), or any other substantially rigid material that may be used to construct the guitar-shaped body 104 and neck 118.

In some embodiments, the guitar-shaped body 104 may include an internal hollowed cavity (not shown) defined by the rear surface 106, the upper surface 108, the left side 110, the right side 112, the front end 114, and the back end 116. The internal hollowed cavity may have an opening (not shown) disposed on the upper surface 108 of the guitar-shaped body 104. The opening may be located on the upper surface 108 disposed centrally between the left side 110 and the right side 112. In addition, the opening may be located on the upper surface 108 disposed centrally between the front end 114 and the back end 116 of the guitar-shaped body 104. In other embodiments, the guitar-shaped body 104 does not include an internal hollowed cavity; rather, it may include a substantially planar surface 108 without apertures on it.

In one embodiment, the guira plate 124 and sound nodules 130*a-n* may be of a rigid metallic material (e.g., aluminum, steel), or any other substantially rigid metallic material. In one embodiment, the sound nodules 130*a-n* may extend perpendicularly from the upper surface 126 of the guira plate 124 and be rounded at a distal tip thereof and enclosed. The nodules 130*a-n* may also be, in some embodiments, partially or fully recessed. However, in preferred embodiments, the rounded nodules extend upwardly from the upper surface a length of approximately 0.1-0.4 inches until they reach the distal tip thereof. In one embodiment, the sound nodules 130*a-n* are tightly placed apart from one another no greater than 0.25 inches apart from base-to-base or tip-to-tip of the sound nodules 130*a-n* of the guira plate 124.

In one embodiment, the plurality of tightly spaced raised sound nodules 130*a-n* may be disposed on over 50% of the upper surface area of the guira plate 124. In other embodiments, the plurality of tightly spaced raised sound nodules 130*a-n* are disposed on over 75% of the upper surface area of the guira plate 124. In other embodiments, the plurality of sound nodules 130*a-n* are disposed on substantially the entire upper surface area of the guira plate 124.

Those of skill in the art will appreciate that, in other embodiments, the upper surface 126 of guira plate 124 may include a variety of textured surfaces capable of making percussion sounds when struck, including, but not limited to knurling, ridges, striations, grooves, or any other textured surface configured to make percussion sounds when struck.

Figure 2:
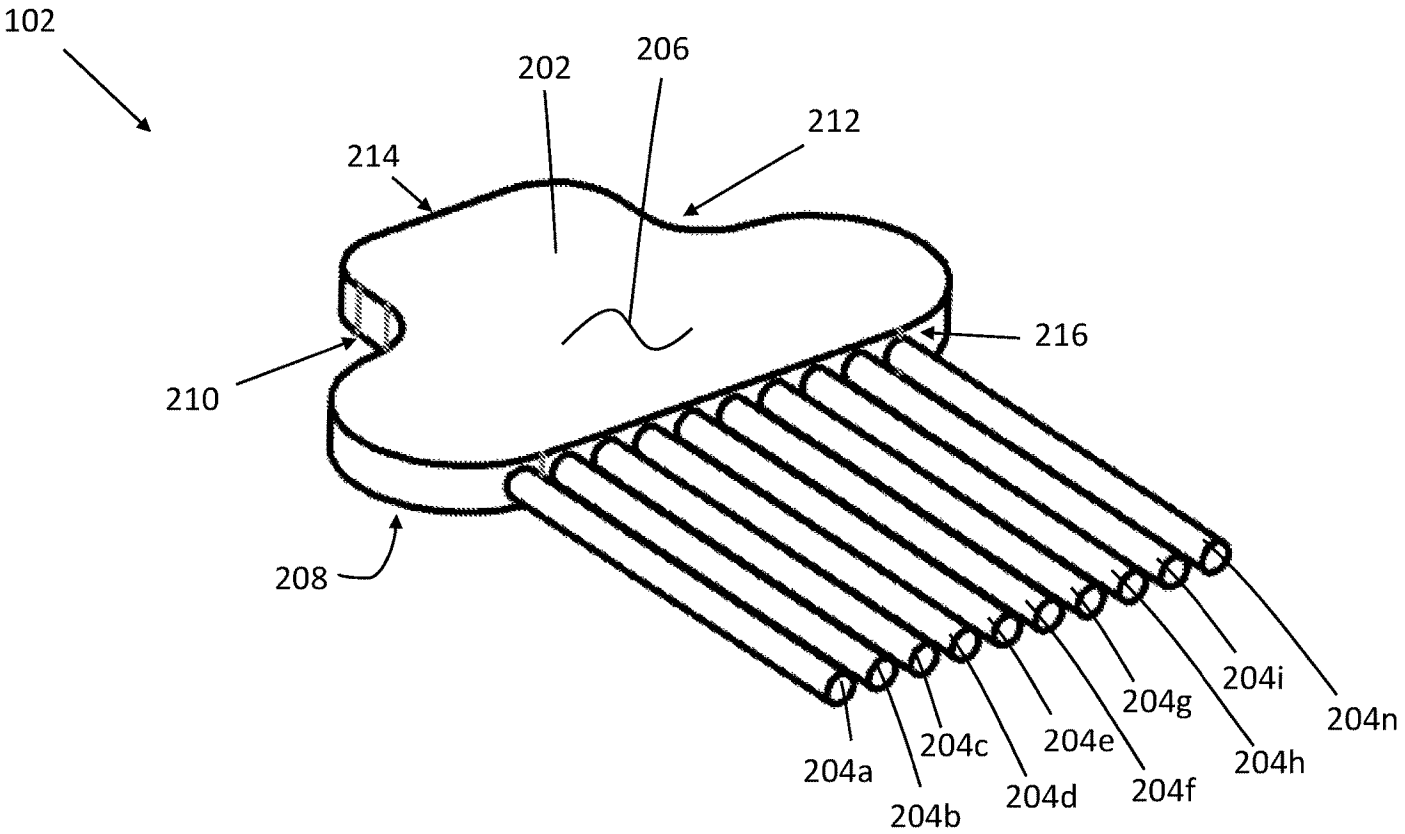
FIG. 2 is a close-up perspective view of the handheld scraper in FIG. 1 to be used in accordance with one embodiment of the present invention.
Figure 3:
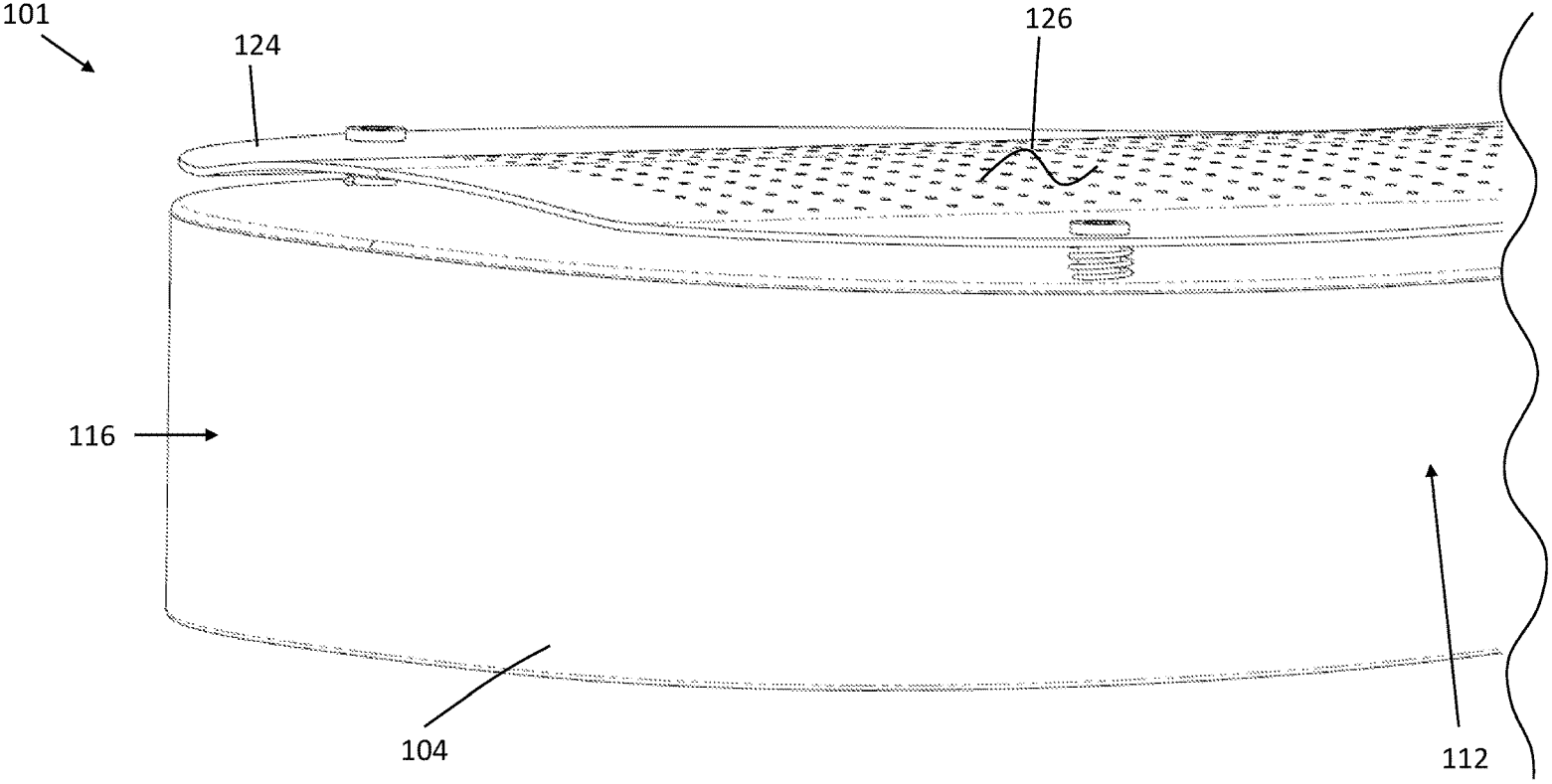
FIG. 3 is a fragmentary elevational side view of the bottom end of a guitar-like body and striking plate in accordance with one embodiment of the present invention.

With reference to FIG. 2, the handle portion 202 of the handheld scraper 102 includes an upper surface 206, a rear surface 208 opposing the upper surface 206, a left side 210, a right side 212 opposing the left side 210, a front end 214, and a back end 216 opposing the front end 214. The handle portion 202 may be of wood, a rigid metallic material (e.g., stainless steel, aluminum), a polymeric material (e.g., PVC), or other substantially rigid material that is operable to be formed into a handle. As shown, the substantially rigid bristles 204*a-n* extend away from the handle portion 202 and are disposed along the back end 216 of the handle portion 202. Moreover, the substantially rigid bristles 204*a-n* are disposed in a substantially parallel configuration (+/−15°) with respect to one another. The substantially rigid bristles 204*a-n* may be of metallic material (e.g., aluminum, steel), or any other substantially rigid material. It should be understood that terms such as, "front," "rear," "side," top," "bottom," and the like are indicated from the reference point of a viewer viewing the handheld scraper 102 from the perspective of its upper surface 206 when the handle portion 202 is facing upwards and the bristles 204*a-n* are facing downwards (see FIG. 2).

Figure 4:
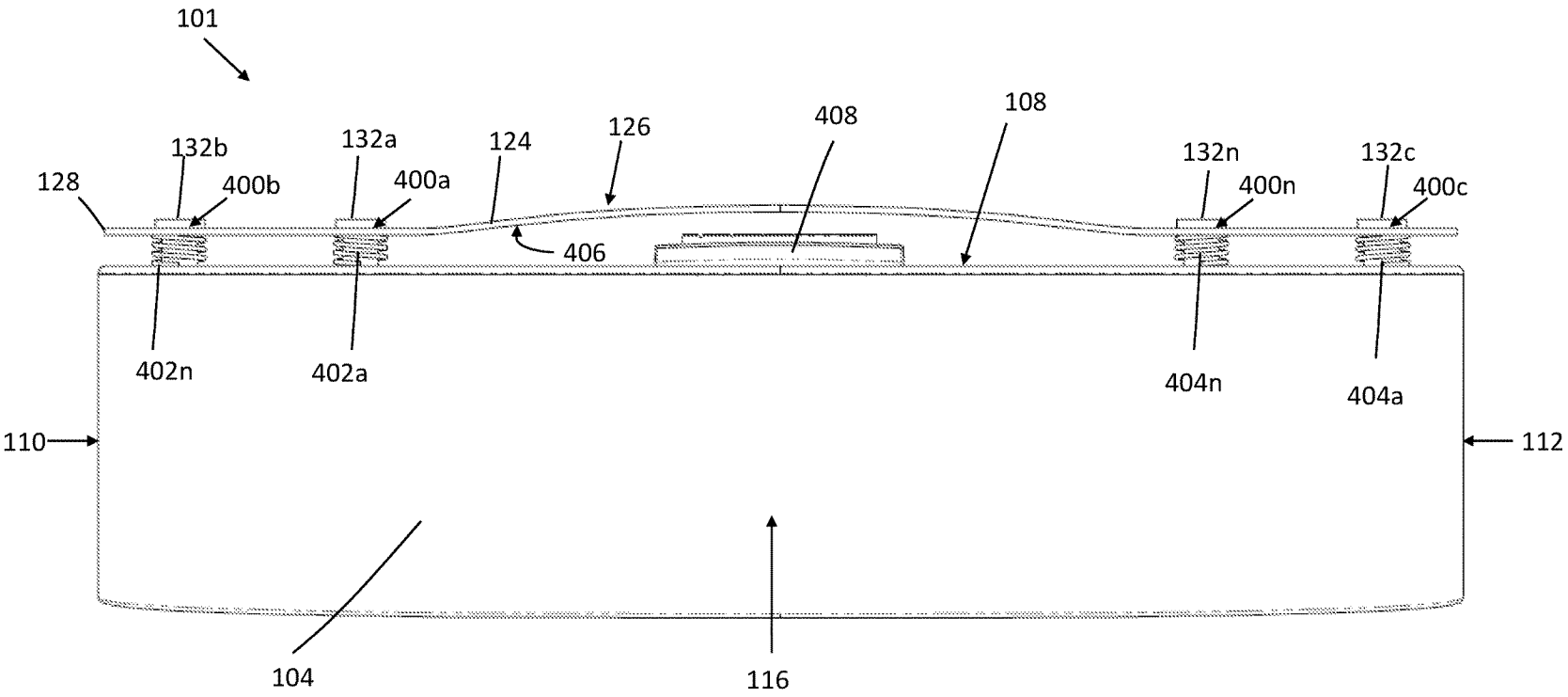
FIG. 4 is an elevational rear view of the guitar-like body in accordance with one embodiment of the present invention.

Referring now to FIG. 4, in an exemplary embodiment, the guira plate 124 may include a plurality of plate fastener openings 400*a-n*, where "n" represents any number greater than one. To effectuate attachment of the guira plate 124 to the upper surface 108 of the guitar-shaped body 104, the plate fasteners 132*a-n* are inserted through the plate fastener openings 400*a-n* on the guira plate 124 and into the upper surface 108 of the guitar-shaped body 104. However, the guira plate 124 may attach to the upper surface 108 of the guitar-shaped body 104 in any manner capable of securing it in place. This includes fastening, gluing, adhering, or any other method for securing two components together. In other embodiments, the guira plate 124 may be incorporated as part of the continuous structure of the guitar-shaped body 104. Said another way, the guira plate 124 may not include a method of attaching, fastening, or adhering to the upper surface 108; rather, it may instead be incorporated into the molding of the upper surface 108 of guitar-shaped body 104.

In the exemplary embodiment shown in FIG. 4, the plate fasteners 132*a-n* may be encompassed or surrounded by a first plurality of spring members 402*a-n*, where "n" represents any number greater than one, and a second plurality of spring members 404*a-n*, where "n" represents any number greater than one. The first and second plurality of spring members 402*a-n*, 404*a-n* are interposed between the rear surface 406 of the guira plate 124 and the upper surface 108 of the guitar-shaped body 104 to provide resiliency or a spring-back effect to the striking plate 124. The first and second plurality of spring members 402*a-n*, 404*a-n* are operably configured to generate a spring force biasing the guira plate 124 in a substantially parallel position with respect to the upper surface 108 of the guitar-shaped body 104. The first plurality of spring members 402*a-n* are located proximal to the left side 110 of the guitar-shaped body 104 and are retained with at least one of the plate fasteners 132*a-n*. The second plurality of spring members 404*a-n* are located proximal to the right side 112 of the guitar-shaped body 104 and are retained with at least one of the plate fasteners 132*a-n*. The amount of plate fastener openings 400*a-n*, plate fasteners 132*a-n*, first plurality of spring members 402*a-n*, and second plurality of spring members 404*a-n* correspond with respect to one another. Said another way, there are an equal amount of plate fastener openings 400*a-n* and plate fasteners 132*a-n* as there are the sum of the first plurality of spring members 402*a-n* and the second plurality of spring members 404*a-n*.

In one embodiment, the first and second plurality of spring members 402*a-n*, 404*a-n* allow the guira plate 124 to deform with respect to the upper surface 108 of the guitar-shaped body 104. Said another way, when an external force (e.g., a user striking the guira plate 124 with the handheld scraper 102) is subjected to the guira plate 124, it may distort from the substantially parallel position with respect to the upper surface 108 of the guitar-shaped body 104. The guira plate 124 may be substantially slender or thin, or approximately 0.1-0.5 inches in thickness, uniformly across the entirety of the guira plate 124.

Those of skill in the art will appreciate that, in some embodiments, the guitar-like base 101 may include a trigger system operably configured to create a signal by detecting the vibrations emerging from the guira plate 124 and transmitting the signal to an electronic component which generates a sound.

Still referring to FIG. 4, the trigger system may include a drum trigger microphone 408 which may be removably mounted on the upper surface 108 of the guitar-shaped body 104. The drum trigger microphone 408 may be interposed between the upper surface 108 of the guitar-shaped body 104 and the rear surface 406 of the guira plate 124. The drum trigger microphone 408 functions as a transducer operably configured to detect vibrations and generate an electrical signal. Moreover, the drum trigger microphone 408 may include an electrical output (not shown). The electrical output is coupled to an electrical lead (not shown) operably configured to communicate the electrical signal from the drum trigger microphone 408 through the electrical lead. The trigger system further includes an electronic component (not shown) operably configured to communicate with the drum trigger microphone 408 and adapted to produce audible sounds representing musical percussion guira sounds based on the received electrical signal. The electronic component may include an input (not shown) of a complementary coupling configuration with respect to the electrical output of the drum trigger microphone 408.

In other embodiments, the drum trigger microphone 408 may instead transfer the electrical signal wirelessly (e.g., Bluetooth technology, radio signals). The drum trigger microphone 408 may include a transmitter (e.g., a Bluetooth transceiver, radio transmitter) operably configured to transmit information. The electronic component may include a receiver (e.g., a Bluetooth receiver, radio receiver) operably configured to receive information.

Those of skill in the art will appreciate that in one embodiment, the electronic component may comprise a speaker operably configured to translate the electrical signal received from the drum trigger microphone 408 into audible sound. In other embodiments, the electronic component may instead couple to a speaker through the use of an electrical output and electrical input. Said another way, the electronic component may couple to a speaker through a data communication cord having a terminal first end with a connector operably configured to communicatively and securely couple to at least one port on the electronic component and a terminal second end with a connector operably configured to communicatively and securely couple to at least one port on the speaker.

In another embodiment, the speaker may couple to an amplifier operably configured to amplify the sounds emerging from the guira plate 124. The speaker may couple to the amplifier through use of an electrical output and electrical input. Said another way, the speaker may couple to the amplifier through a data communication cord having a terminal first end with a connector operably configured to communicatively and securely couple to at least one port on the speaker and a terminal second end with a connector operably configured to communicatively and securely couple to at least one port on the amplifier.

Figure 5:
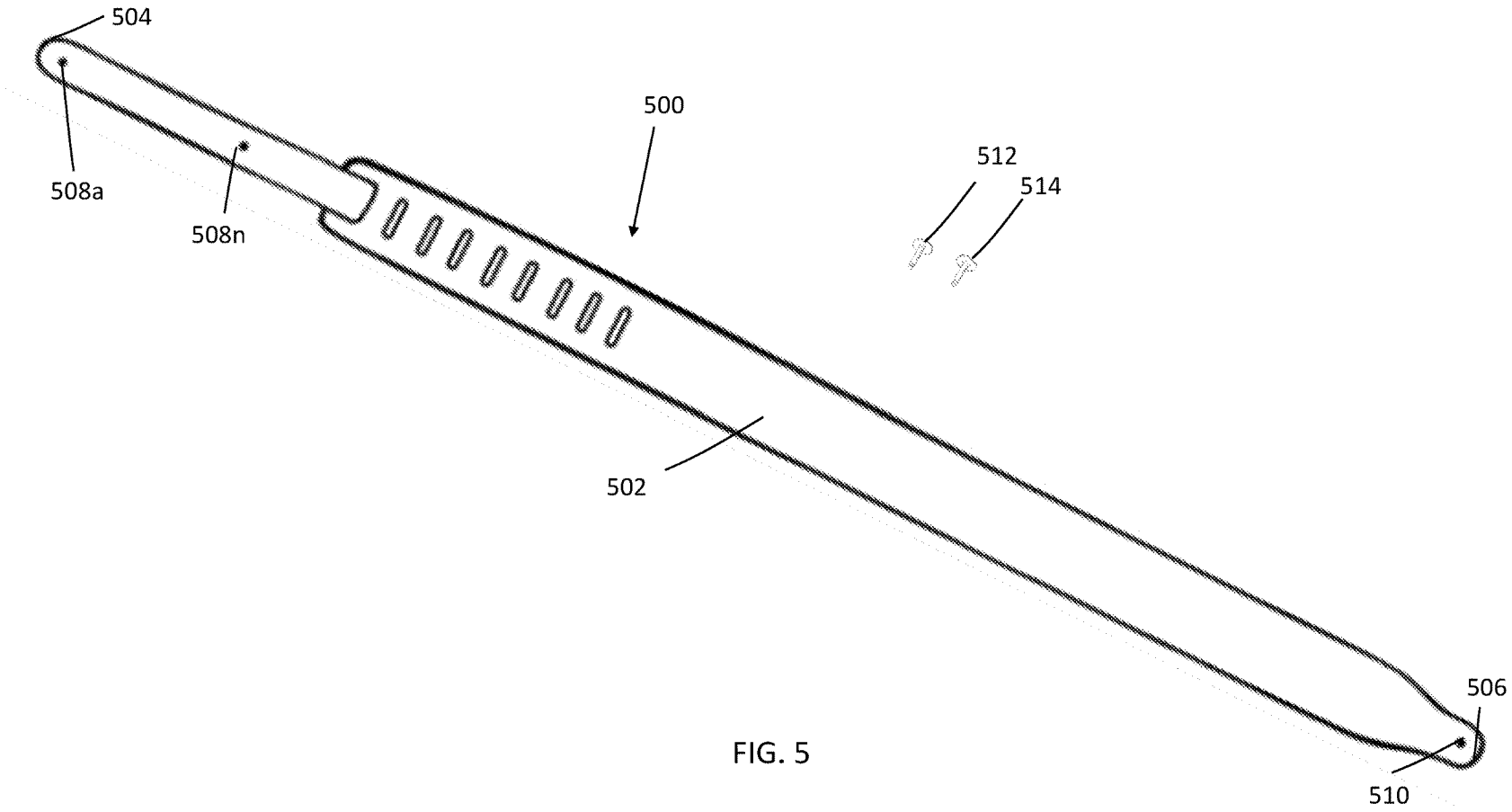
FIG. 5 is a top plan view of an adjustable shoulder strap assembly that may be used in combination with one embodiment of the present invention.

In some embodiments, an adjustable shoulder strap assembly may be utilized with this invention for ease of wear. Although the adjustable shoulder strap may vary, FIG. 5 shows an exemplary adjustable shoulder strap assembly 500 which includes a strap 502. The strap 502 includes a first end 504 and a second end 506 opposing the first end 504. The first and second ends 504, 506 may be attached to the guitar-like base 101 utilizing pin members 512, 514. However, in other embodiments, the shoulder strap assembly 500 may be attached to the guitar-like base 101 by any means whereby the shoulder strap assembly 500 can be secured. This includes fastening, gluing, adhering, or any other method for securing two components together.

Still referring to FIG. 5, the strap 502 may include a plurality of pinholes 508*a-n*, where "n" represents any number greater than one. The plurality of pinholes 508*a-n* are disposed in close proximity to the first end 504 of strap 502. Moreover, the strap 502 may include a pinhole 510 disposed in close proximity to second end 506. A user may attach the strap 502 to the guitar-like base 101 by completing the following steps: insert at least one of the pin members 512, 514 through at least one of the plurality of pinholes 508*a-n* and into the guitar-like base 101 and insert at least one of pin members 512, 514 through the pinhole 510 and into the guitar-like base 101. Thereafter, once the strap 502 is attached onto the guitar-like base 101, it establishes an empty space (not shown) defined by the strap enclosure with respect to the guitar-shaped body 104 which a user may insert their body through. Moreover, a user may establish their preferred placement of the strap 502. When a user inserts at least one of the pin members 512, 514 through one of the plurality of pinholes 508*a-n* disposed closer to the first end 504, the strap 502 becomes looser around the user's body. Similarly, when a user inserts at least one of the pin members 512, 514 through one of the plurality of pinholes 508*a-n* which are disposed further from the first end 504, the strap 502 becomes tighter around the user's body.

A handheld guira assembly has been disclosed that includes a guitar-like base and a handheld scraper. The handheld scraper consists of a handle portion coupled to a plurality of metal bristles. The guitar-like base consists of a guitar-shaped body and a neck. The guitar-shaped body is coupled to a metal guira plate which includes a plurality of sound nodules. The plurality of sound nodules are designed to make percussion sounds when struck with the handheld scraper.

What is claimed is:

1. A handheld guira assembly comprising:

a guitar-shaped body having a rear surface, an upper surface opposing the rear surface, a left side, a right side opposing the left side, a front end, and a back end opposing the front end;

a neck with a proximal end coupled to the front end of the guitar-shaped body and extending outwardly therefrom to a distal terminal free end, wherein the guitar-shaped body and neck are operably configured to be handheld; and a spring-loaded and substantially rigid guira plate:

coupled to and superimposing the upper surface of the guitar-shaped body;

having a rear surface and an upper surface opposing the rear surface of the guira plate and with an upper surface area defined by an outer perimeter of the upper surface of the guira plate; and having a plurality of tightly spaced raised sound nodules disposed on over 50% of the upper surface area of the guira plate.

2. The handheld guira assembly according to claim 1, wherein:

the guira plate and sound nodules are of a metallic material.

3. The handheld guira assembly according to claim 1, further comprising:

a handheld scraper with a handle portion and a plurality of substantially rigid bristles extending away from and coupled to the handle portion, the plurality of bristles disposed in a parallel configuration with one another.

4. The handheld guira assembly according to claim 1, wherein:

the sound nodules are rounded at a distal tip thereof and enclosed.

5. The handheld guira assembly according to claim 4, wherein:

the sound nodules are tightly placed apart from one another no greater than 0.25 inches.

6. The handheld guira assembly according to claim 5, wherein:

the plurality of sound nodules are disposed on over 75% of the upper surface area of the guira plate.

7. The handheld guira assembly according to claim 5, wherein:

the plurality of sound nodules are disposed on substantially the entire upper surface area of the guira plate.

8. The handheld guira assembly according to claim 1, further comprising:

a strap having a first end and a second end each coupled to the guitar-shaped body to define a strap enclosure with respect to the guitar-shaped body.

9. The handheld guira assembly according to claim 1, further comprising:

a first plurality of spring members disposed proximal to the left side of the guitar-shaped body, interposed between the upper surface of the guitar-shaped body and the rear surface of the guira plate, and each retained, respectively, with a plate fastener; and a second plurality of spring members disposed proximal to the right side of the guitar-shaped body, interposed between the upper surface of the guitar-shaped body and the rear surface of the guira plate, and each retained, respectively, with a plate fastener.

10. A handheld guira assembly comprising:

a body having a rear surface, an upper surface opposing the rear surface, a left side, a right side opposing the left side, a front end, and a back end opposing the front end;

a neck with a proximal end coupled to the front end of the body and extending outwardly therefrom to a distal terminal free end, wherein the body and neck are operably configured to be handheld; and a substantially rigid guira plate coupled to the body and having:

a rear surface and an upper surface opposing the rear surface of the guira plate and with an upper surface area defined by an outer perimeter of the upper surface of the guira plate, the guira plate superimposing the upper surface of the body; and a plurality of tightly spaced raised sound nodules disposed on over 75% of the upper surface area of the guira plate.

11. The handheld guira assembly according to claim 10, wherein:

the guira plate is coupled to the upper surface of the body with a plurality of spring members, thereby allowing the guira plate to deform with respect to the upper surface of the body.

12. The handheld guira assembly according to claim 11, wherein the plurality of spring members further comprises:

a first plurality of spring members disposed proximal to the left side of the guitar-shaped body, interposed between the upper surface of the guitar-shaped body and the rear surface of the guira plate, and each retained, respectively, with a plate fastener; and a second plurality of spring members disposed proximal to the right side of the guitar-shaped body, interposed between the upper surface of the guitar-shaped body and the rear surface of the guira plate, and each retained, respectively, with a plate fastener.

13. The handheld guira assembly according to claim 10, further comprising:

a strap having a first end and a second end each coupled to the guitar-shaped body to define a strap enclosure with respect to the guitar-shaped body.

14. A handheld guira assembly comprising:

a guitar-like base having:

a guitar-shaped body having:

a rear surface, an upper surface opposing the rear surface, a left side, a right side opposing the left side, a front end, and a back end opposing the front end;

a substantially rigid guira plate:

of a metallic material;

having a plurality of plate fastener openings;

coupled to the upper surface of the guitar-shaped body utilizing a plurality of plate fasteners;

having a rear surface and an upper surface opposing the rear surface of the guira plate and with an upper surface area defined by an outer perimeter of the upper surface of the guira plate, the guira plate superimposing the upper surface of the guitar-shaped body;

having a textured surface disposed on substantially the entire upper surface area of the guira plate;

a neck having:

a proximal end coupled to the front end of the guitar-shaped body and extending outwardly therefrom to a distal terminal free end, wherein the guitar-shaped body and neck are operably configured to be handheld;

a handheld scraper having:

a handle portion;

a plurality of substantially rigid bristles:

of a metallic material;

extending away from and coupled to the handle portion; and disposed in a parallel configuration with one another.

15. The handheld guira assembly according to claim 14, wherein the guitar-shaped body further comprises:

a first plurality of spring members disposed proximal to the left side of the guitar-shaped body, interposed between the upper surface of the guitar-shaped body and the rear surface of the guira plate, and each retained, respectively, with at least one of the plurality of plate fasteners; and a second plurality of spring members disposed proximal to the right side of the guitar-shaped body, interposed between the upper surface of the guitar-shaped body and the rear surface of the guira plate, and each retained, respectively, with at least one of the plurality of plate fasteners.

16. The handheld guira assembly according to claim 14, further comprising:

a strap having a first end and a second end each coupled to the guitar-like base to define a strap enclosure with respect to the guitar-like base.

17. The handheld guira assembly according to claim 14, further comprising:

a trigger system operably configured to create a signal by detecting vibrations emerging from the guira plate and transmitting the signal to an electronic component which generates a sound.

18. The handheld guira assembly according to claim 17, wherein the trigger system further comprises:

a drum trigger microphone operably configured to detect vibrations and generate an electrical signal and configured to be removably mounted onto the upper surface of the guitar-shaped body, interposed between the upper surface of the guitar-shaped body and the rear surface of the guira plate, and having an electrical output coupled to an electrical lead operably configured to communicate the electrical signal; and an electronic component operably configured to communicate with the drum trigger microphone and adapted to produce sounds representing musical percussion guira sounds based on the received electrical signal, and having an input of complementary coupling configuration with the electrical output.

* * * * *